US010794138B2

(12) United States Patent
Derryberry et al.

(10) Patent No.: US 10,794,138 B2
(45) Date of Patent: Oct. 6, 2020

(54) MODULAR MANIFOLD SYSTEM FOR AN ELECTROHYDRAULIC CONTROL SYSTEM

(71) Applicant: Halliburton Energy Services, Inc., Houston, TX (US)

(72) Inventors: Benjamin Thomas Derryberry, Plano, TX (US); Darrin Nathaniel Towers, Shady Shores, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 15 days.

(21) Appl. No.: 15/579,898

(22) PCT Filed: Jul. 9, 2015

(86) PCT No.: PCT/US2015/039811
§ 371 (c)(1),
(2) Date: Dec. 5, 2017

(87) PCT Pub. No.: WO2017/007491
PCT Pub. Date: Jan. 12, 2017

(65) Prior Publication Data

US 2018/0179847 A1 Jun. 28, 2018

(51) Int. Cl.
*E21B 33/035* (2006.01)
*E21B 34/04* (2006.01)
(Continued)

(52) U.S. Cl.
CPC ..... *E21B 33/0355* (2013.01); *E21B 34/04* (2013.01); *E21B 34/045* (2013.01);
(Continued)

(58) Field of Classification Search
CPC .... E21B 33/0355; E21B 34/04; E21B 34/045; E21B 47/0001; E21B 47/001
See application file for complete search history.

(56) References Cited

U.S. PATENT DOCUMENTS 4,658,904 A 4/1987 Doremus et al.
4,880,060 A 11/1989 Schwendemann et al.
(Continued)

FOREIGN PATENT DOCUMENTS

WO 2014210435 12/2014

OTHER PUBLICATIONS

International Search Report and Written Opinion of PCT Application No. PCT/US2015/039811 dated Feb. 25, 2016: pp. 1-15.
(Continued)

*Primary Examiner* — Matthew R Buck
(74) *Attorney, Agent, or Firm* — Chamberlain Hrdlicka

(57) ABSTRACT

A modular manifold system includes a first manifold ring which comprises a first tubular body defined by an inner wall, an outer wall, a first end, and a second end. The inner wall and the outer wall extend between the first end and the second end. The first manifold ring also includes a first path formed between the inner wall and the outer wall and extending to at least one of the first end and the second end. At least one of the first end and second end comprises a coupling feature configured to couple the first manifold ring to a second manifold ring or well equipment. The first path is put in fluid communication or electrical communication with the second manifold ring or well equipment when the first manifold ring is coupled to the second manifold ring.

19 Claims, 4 Drawing Sheets

(51) Int. Cl.
*E21B 47/001* (2012.01)
*E21B 33/04* (2006.01)

(52) U.S. Cl.
CPC ..... *E21B 47/001* (2020.05); *E21B 33/04* (2013.01); *E21B 2200/04* (2020.05)

(56) References Cited

U.S. PATENT DOCUMENTS

| | | | | |
|---|---|---|---|---|
| 8,118,105 | B2 * | 2/2012 | Wright | E21B 34/10 166/378 |
| 8,517,112 | B2 * | 8/2013 | Niemeyer | E21B 34/16 166/250.01 |
| 2011/0120722 | A1 * | 5/2011 | Scranton | E21B 33/0355 166/360 |
| 2011/0137471 | A1 | 6/2011 | Dailey, Jr. | |
| 2011/0226482 | A1 | 9/2011 | Trewhella et al. | |

OTHER PUBLICATIONS

Kirkland et al., OTC 8244: "DeepStar Evaluation of Subsea Trees and Manifold Concepts," Offshore Technology Conference, 1996: pp. 835-844.

Muller et al., EUR 177: "New Development in Subsea Production—The Modular Manifold Concept," European Offshore Petroleum Conference & Exhibition, Oct. 1980: pp. 1-6.

Roblin, "New Technology for Modular Subsea Manifold," Advances in Underwater Technology, Ocean Science and Offshore Engineering, 1987, vol. 10: pp. 131-142.

* cited by examiner

MODULAR MANIFOLD SYSTEM FOR AN ELECTROHYDRAULIC CONTROL SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

Landing strings are installed within BOP stacks with offshore rigs on subsea wells in order to monitor, control, and seal the wells should pressure or flow situations demand. Landing strings are often installed as tubulars installed on the wellhead. A landing string may include various sensors, pressure containment components, valves and other components depending on the BOP design and the type of well. Many of these components are controlled hydraulically or electrically. Thus, the landing string may be coupled to an electrohydraulic control system and manifold. These manifolds provide hydraulic control lines as well as electrical control lines to a landing string inside within the BOP stack, and may include a retainer valve, subsea test tree, tubing hanger running tool, tubing hanger, or any combination thereof. Typically, these control lines are typically hard-built and exposed across the entire manifold for each well or application.

BRIEF DESCRIPTION OF THE DRAWINGS

For a detailed description of the embodiments of the invention, reference will now be made to the accompanying drawings in which.

DETAILED DESCRIPTION

The present disclosure is directed towards an electrohydraulic manifold system that is made of one or more modular manifold rings. Each modular manifold ring includes a self-contained set of electrohydraulic control lines or paths and operational components such as electronics, sensors, valves, and the like. When one or more modular manifold rings are connected together, they form a complete electrohydraulic manifold system. If certain portions of the electrohydraulic manifold system need to be replaced or repaired, the respective modular manifold ring can be removed for repair or replaced without affecting the remaining modular manifold rings. The modular manifold rings can be prefabricated in various designs configured to carry out different functions of an electrohydraulic manifold system. Thus, different combinations of the modular manifold rings can be used together for specific applications without the need to design the entire system from scratch.

Figure 1:
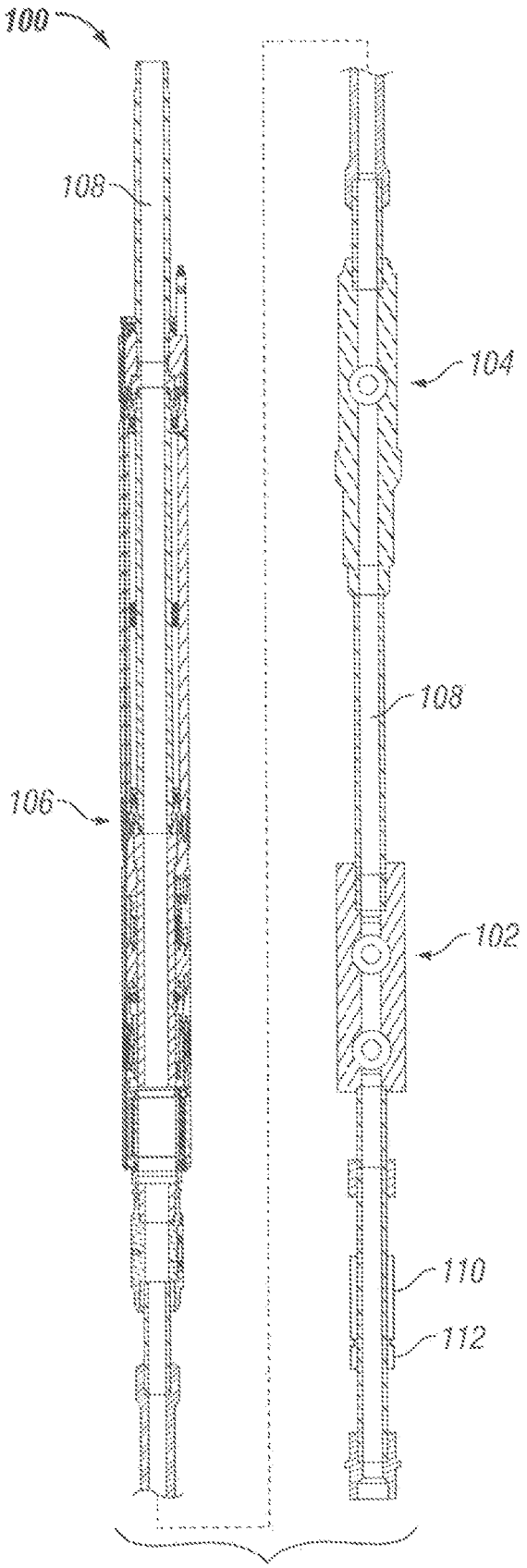
FIG. 1 is a schematic view of a landing string with a modular manifold system.

Referring now to the figures, FIG. 1 is a schematic view of a subsea safety tree system 100 with a modular manifold system, in accordance with example embodiments of the present disclosure. In some embodiments, the subsea safety tree system 100 includes a subsea safety tree 102 and a retainer valve 104. In some embodiments, a modular electrohydraulic manifold system 106 is located above the retainer valve 104 in vertical alignment with the retainer valve 104 and the subsea safety tree 102. In FIG. 1, the modular electrohydraulic manifold system 106, the retainer valve 104, and the subsea safety tree 102 are shown separated from each other to isolate and distinguish between the components. More typically, the modular electrohydraulic manifold system 106, the retainer valve 104, and the subsea safety tree 102 would be coupled together end to end during operation. The modular electrohydraulic manifold system 106, the retainer valve 104, and the subsea safety tree 102 are disposed around a production pipe 108 through which production fluids may be recovered. In some embodiments, the system 100 also includes a tubing hanger running tool 110 and a tubing hanger 112.

The modular electrohydraulic manifold system 106 may be configured to control aspects of the subsea safety tree 102, the retainer valve 104, the tubing hanger running tool 110, the tubing hanger 112, or any other electrohydraulically or pneumatically controlled components of a landing string or other well equipment. In some embodiments, tubing hanger running tool 110 is used to run, land, and lock a tubing hanger in a subsea tree or other equipment such as a wellhead or tubing spool.

The modular electrohydraulic manifold system 106 may be connected to and controlled by a direct electrohydraulic control panel at the well site, which can send electrohydraulic signals for actuating valves, pumps, and the like on the retainer valve 104 and subsea safety tree 102. The control panel may also transmit signals for operating electronic components of the modular electrohydraulic manifold system 106. The control panel may also provide power to the modular electrohydraulic manifold system 106 such as to activate solenoids. In some embodiments, one or more electric lines run from the top of the modular electrohydraulic manifold system 106 into a junction box in the modular electrohydraulic manifold system 106 to the solenoids and any other power consuming components.

The schematic 100 of FIG. 1 illustrates one example application and configuration of the modular electrohydraulic manifold system 106 and does not limit the possible applications and configurations of the modular electrohydraulic manifold system 106. The modular electrohydraulic manifold system 106 can be used with other types of subsea or land well equipment as will be appreciated by one skilled in the art.

Figure 2:
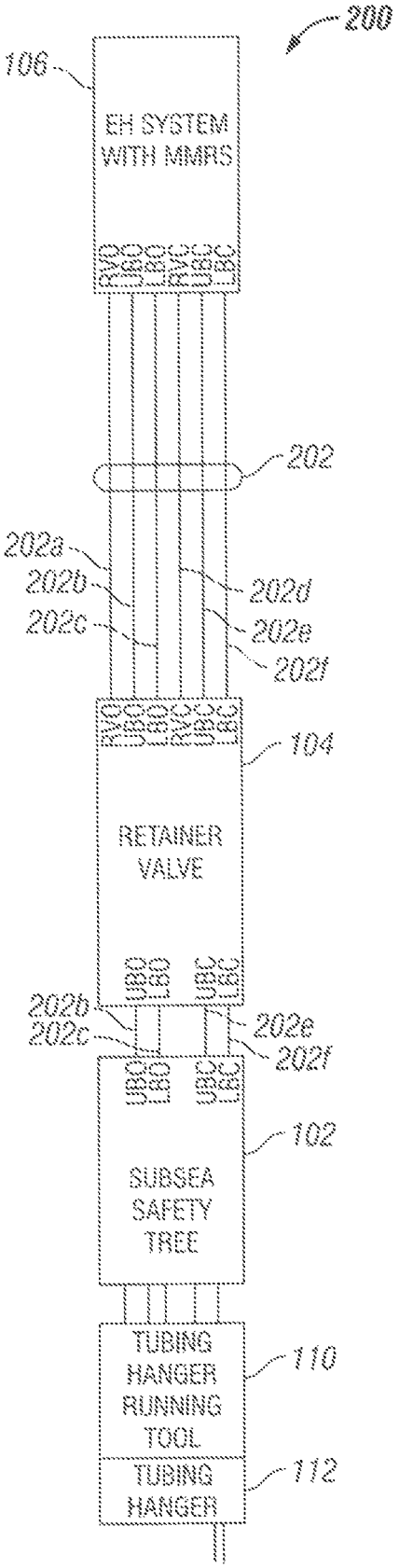
FIG. 2 is a schematic diagram of the control lines of the landing string stack of FIG. 1.

FIG. 2 is a schematic diagram of the electrohydraulic control lines of the modular electrohydraulic manifold system 106 of FIG. 1. In this example embodiment, the modular electrohydraulic manifold system 106 controls various ball valves and retention valves in the subsea safety tree 102 and retainer valve 104. In some embodiments, the modular electrohydraulic manifold system 106 also controls aspects of the tubing hanger running tool 110 and the tubing hanger 112. Specifically, the modular electrohydraulic manifold system 106 provides control lines 202 connected to the retainer valve 104. The control lines 202 include a lower ball open (LBO) line 202*a*, an upper ball open (UBO) line 202*b*, a retainer valve open (RVO) line 202*c*, an upper ball closed (UBC) line 202*d*, a lower ball closed (LBC) line 202*e*, and a retainer valve closed (RVC) line 202*f*. The retainer valve open (RVO) line 202*c* and the retainer valve closed (RVC) line 202*f* control the retainer valve 104 and thus terminate at the retainer valve 104. The lower ball open (LBO) line 202*a*, upper ball open (UBO) line 202*b*, upper ball closed (UBC) line 202*d*, and lower ball closed (LBC) line 202*e* control ball valves in the subsea safety tree 102 and thus continue from the retention valve 104 to the subsea test tree 102. In other embodiments and applications, the modular electrohydraulic manifold system 106 may include more or less control lines than illustrated in FIG. 2, and the control lines may connect to and control aspects of additional or alternative equipment.

Figure 3:
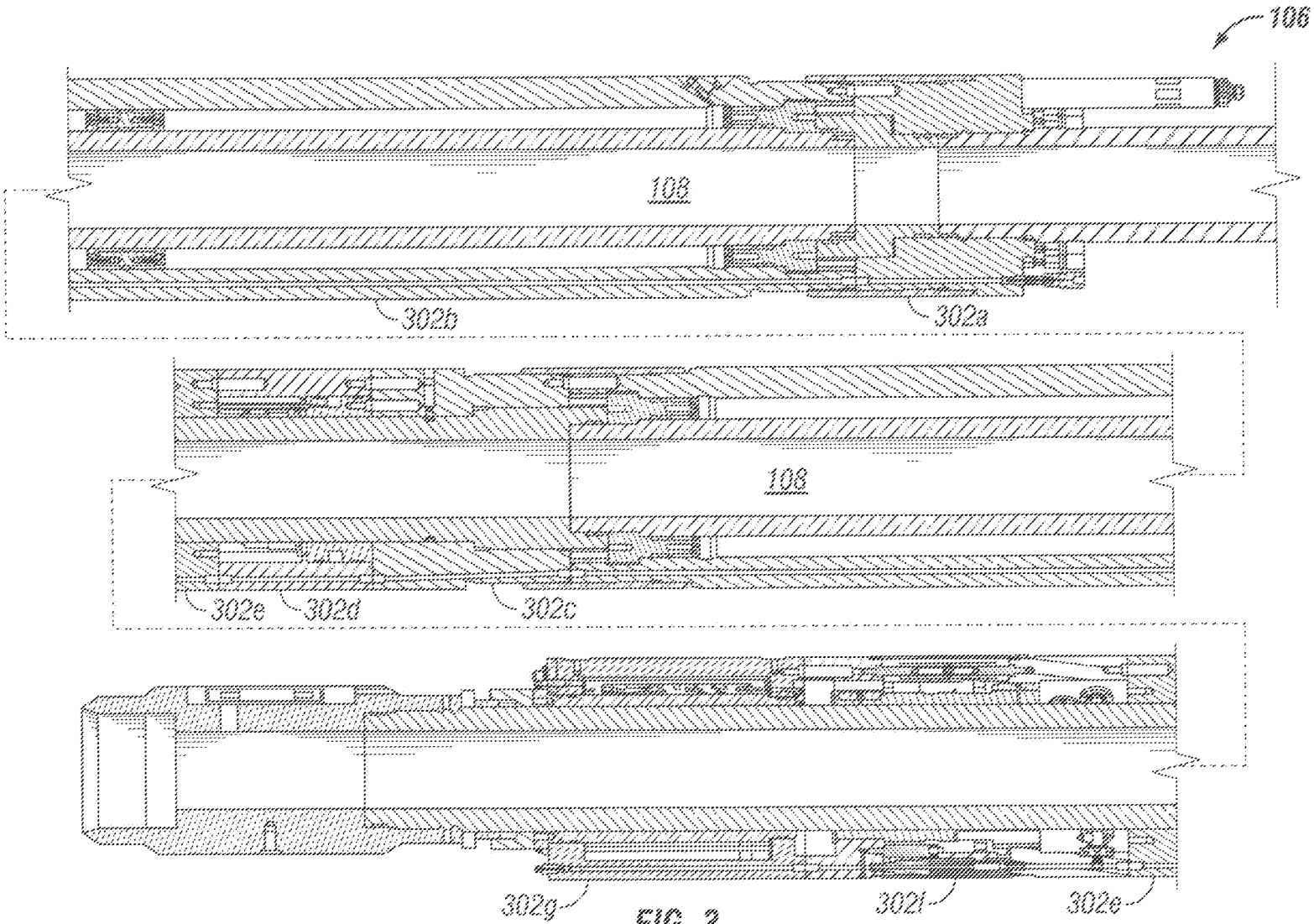
FIG. 3 is a cross-sectional view of a modular manifold system comprising a plurality of modular manifold rings.

FIG. 3 is a cross-sectional view of an embodiment of a modular electrohydraulic manifold system 106 comprising a plurality of modular manifold rings 302. The modular manifold rings 302 are combined together to form an electrohydraulic manifold. Each modular manifold ring includes electrical or hydraulic lines as well as equipment or components as needed to control or perform certain functions. In the illustrated embodiment, the electrohydraulic manifold includes a modular umbilical connector ring 302*a*, a modular accumulator ring 302*b*, a modular adapter ring 302*c*, a modular solenoid ring 302*d*, a modular valve ring 302*e*, a modular sensor ring 302*f*, and a modular electronics ring 302*g*. However, a modular manifold ring 302 can have any type of function or design structure and is not limited to the specific examples named above.

Figure 4:
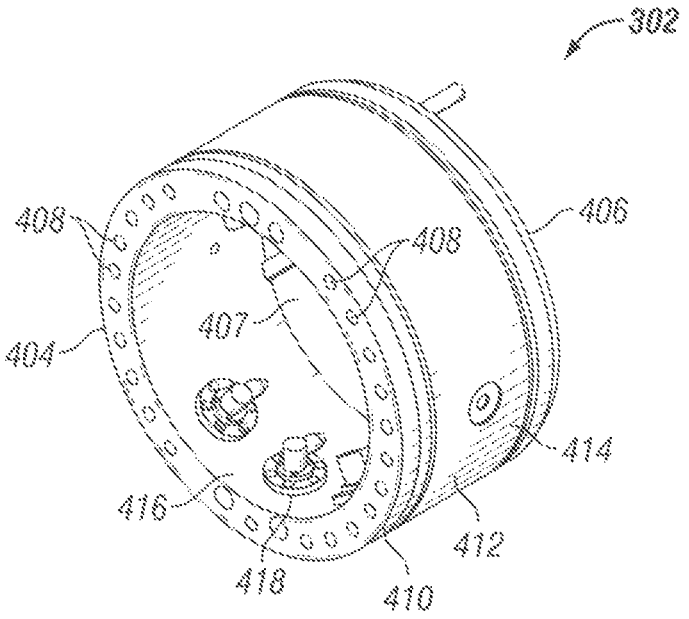
FIG. 4 is a perspective view of a modular manifold ring with internally disposed components.

FIG. 4 is a perspective view of an example modular manifold ring 302 with internally disposed components, in accordance with example embodiments of the present disclosure. The modular manifold ring 302 includes a tubular structure having a first end 404 and a second end 406. The tubular structure provides a central opening 407 through which the production pipe 108 can be disposed. The modular manifold ring 302 further includes at least one path 408 extending to the first end 404, the second end 406, or both. In some embodiments, the path 408 traverses the modular manifold ring 302 and extends from the first end 404 to the second end 406.

Figure 5:
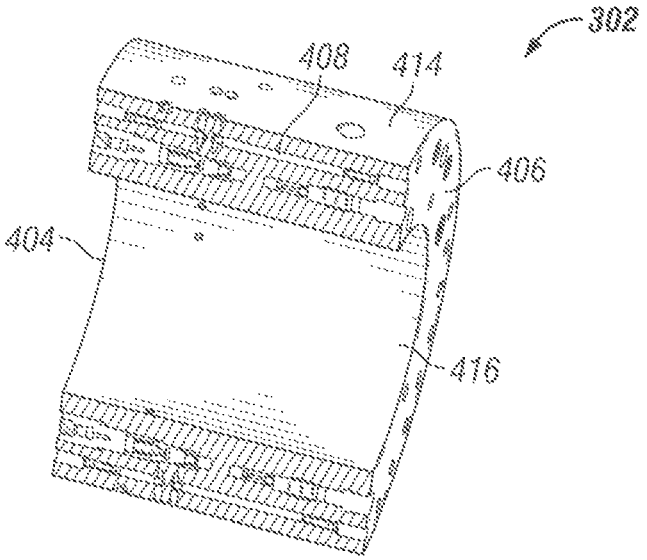
FIG. 5 is a cross-sectional view a modular manifold ring with internally disposed components.

In the embodiment of FIG. 4, the tubular structure of the modular manifold ring 302 is a tubular body 412 having an outer surface 414 and in inner surface 416. In certain such embodiments, the path 408 is formed within or extruded from the tubular body 412 between the outer surface 414 and the inner surface 416. The path 408 is further illustrated in the FIG. 5, which shows a cross-sectional view of a modular manifold ring 302. The tubular structure may also be defined by a tubular orientation of one or more paths. In some embodiments, the path 408 provides at least a portion of a control line of the electrohydraulic manifold. The path 408 may provide a hydraulic control line, a pneumatic control line, or an electrical control line. In some embodiments, a conductive wire or structure is disposed within the path 408.

The tubular structure of the modular manifold ring 302 is not limited to having a circular cross-section. In some embodiments, the tubular structure can have any geometric or non-geometric cross-sectional shape or combination of cross-sectional shapes suitable for disposing around a production pipe. For example, the inner surface 416 of the tubular structure may have a circular cross-sectional shape and the outer surface 414 of the tubular structure may have a polygonal cross-sectional shape.

Referring again to FIG. 4, the modular manifold ring 302 may include one or more components 418 disposed within, partially within, on the inner surface, or on the outer surface 416 of the tubular body 412. In some embodiments, the modular manifold ring 302 may include a sensor, a solenoid, an accumulator, an umbilical connector, a valve, an electronics module, or any combination thereof. The modular manifold ring 302 may also include actuators, chemical injection lines, and other applicable components.

The modular manifold ring 302 also includes a coupling feature 410 configured to couple the modular manifold ring 302 to another modular manifold ring 302 or equipment, such as the retainer valve 104 (FIG. 1). In some embodiments, the coupling feature 410 is disposed at the first end 404, the second end 406, or both. The coupling feature 410 can be any kind of feature which is coupleable to a corresponding coupling feature of another modular manifold ring 302 such that the central openings 407 of the two modular manifold rings 302 are aligned. In some embodiments, the coupling between the two modular manifold rings 302 are sealed and fluid-tight such that any fluid passed between the coupled modular manifold rings 302 does not escape. An example coupling feature 410 is a flange with through-holes which can be bolted to another flange. In some examples, the modular manifold rings 302 may include externally or internally threaded ends which may mate directly with each other or via a mating collar. Another example coupling features 410 may include a central mandrel passing through two or more modular manifold rings 302 with threads and a threaded retaining/clamping tubular.

In some embodiments, the modular manifold ring 302 includes a keying feature which only allows the modular manifold ring 302 to couple to a compatible modular manifold ring, ensuring that only compatible modular manifold rings are coupled together. Additionally, in some embodiments, the modular manifold ring 302 may only couple to another modular manifold ring 302 in a certain configuration such that the right parts of the modular manifold rings match up. For example, two modular manifold rings 302 may only be coupled together the paths 408 of the modular manifold rings 302 are corrected aligned.

When two modular manifold rings 302 are coupled together, the path 408 of a first modular manifold ring 302 is joined to the path 408 of the second modular manifold ring 302 such that the paths 408 are in fluid or electrical communication, forming a connected portion of an electrohydraulic control line. Thus, electric, hydraulic, or pneumatic signals are carried through the first and second modular manifold rings 302. A modular electrohydraulic manifold system 106 can include any number of modular manifold rings 302 combined together. Additional modular manifold rings 302 can be added to a modular electrohydraulic manifold system 106. One or more modular manifold rings 302 can be removed or replaced from a modular electrohydraulic manifold system 106. Certain types of modular manifold rings 302 may serve different functions and provide the components for certain aspects of an electrohydraulic manifold system.

As an example, referring back to FIG. 3, the illustrated modular electrohydraulic manifold system 106 includes a modular umbilical connector ring 302*a*, a modular accumulator ring 302*b*, a modular adapter ring 302*c*, a modular solenoid ring 302*d*, a modular valve ring 302*e*, a modular sensor ring 302*f*, and a modular electronics ring 302*g*. The modular umbilical connector ring 302*a* may include an adapter to an umbilical connector and is configured to pass communication to and through the tool. The modular accumulator ring 302*b* may include piston or bladder type accumulator(s) and is configured to provide hydraulic power to downhole tools or subsea landing string. The modular adapter ring 302*c* may include necessary profiles for coupling multiple modular manifold rings and is configured to adapt modular manifold rings with different pitch circle diameters. The modular solenoid ring 302*d* may include one or more solenoids and is configured to operate other valves or tools. The modular valve ring 302*e* may include one or more valves and is configured to operate various other valves or tools. The modular sensor ring 302*f* may include one or more sensor and is configured to sense various conditions and provide the respective data. The modular electronics ring 302*g* may include the electronics for communicating to the surface computers and is configured to read all sensor information or control other modular manifold rings 302 such as the valve ring 302*e* or solenoid ring 302*d*.

Figure 6:
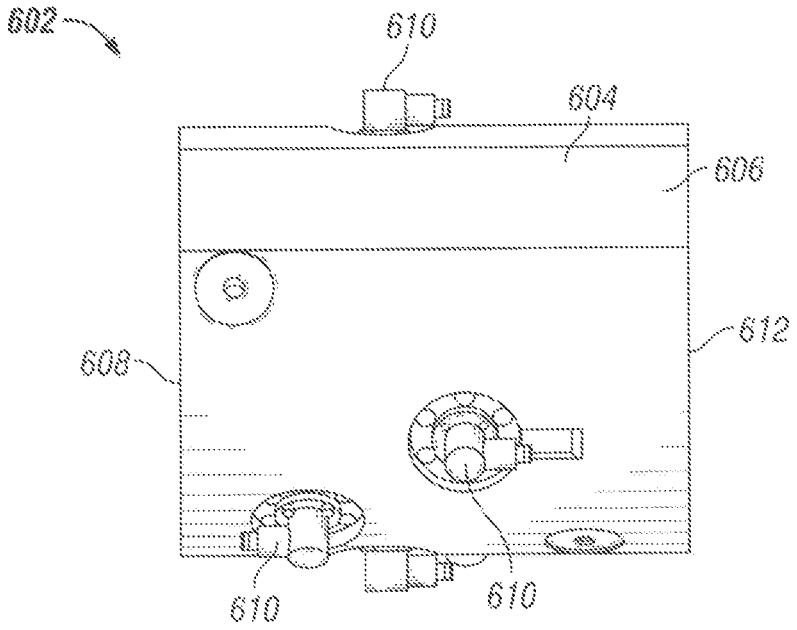
FIG. 6 is a side view of a plurality of modular manifold rings with externally disposed components.

FIG. 6 is a schematic view of a modular manifold ring 602 with externally disposed components, in accordance with example embodiments of the present disclosure. In such embodiment, the modular manifold ring 602 still includes a tubular body 604 including an outer surface 606 and an inner surface (not shown) that defines a central opening (not shown) for receiving a production pipe. The tubular body 604 also includes a first end 608 and a second end 612, at least one of which includes a coupling feature for connecting the modular manifold ring 602 to another modular manifold ring 602 or equipment. In some embodiments, the modular manifold ring 602 includes one or more components 610 extending through the outer surface 606 or disposed on the outer surface 606. In some such embodiments, the connections for the components 610 are disposed within the tubular body 604 either on the outer surface 606 or between the inner surface and the outer surface 606.

In some embodiments, the tubular structure is a sheath and the control lines or paths are disposed on the outside of the sheath. The modular manifold rings are coupleable to each other end to end and portions of one or more electrohydraulic control lines are connected when the modular manifolds rings 602 are coupled together, forming an electrohydraulic manifold system.

In addition to the embodiments described above, many examples of specific combinations are within the scope of the disclosure, some of which are detailed below:

Example 1

A control system for controlling subsea well equipment, comprising:

a manifold comprising at least one manifold module, each manifold module comprising:

a body including an inner wall defining an orifice, an outer wall, a first end, and a second end; and a path formed between the inner wall and the outer wall and extending to at least one of the first end and the second end, wherein the path is configured to provide communication with at least one of another manifold module and the subsea well equipment.

Example 2

The control system of claim 1, wherein the path is extruded from the body.

Example 3

The control system of claim 1, wherein the path includes an electrically conductive path, a hydraulic path, a pneumatic path, or any combination thereof.

Example 4

The control system of claim 1, wherein the orifice is configured to receive a pipe therethrough.

Example 5

The control system of claim 1, wherein when a manifold module is coupled to another manifold module, the paths in each module are coupled via a seal.

Example 6

The control system of claim 1, wherein the manifold module further comprises a first coupling mechanism and is couplable to another manifold module or well equipment only if the other manifold module or well equipment comprises a second coupling mechanism compatible with the first coupling mechanism.

Example 7

The control system of claim 1, wherein the body of a module comprises a ring.

Example 8

The control system of claim 1, wherein the manifold module is a part of an electrohydraulic control system.

Example 9

The control system of claim 1, wherein the manifold module comprises at least one of a sensor, a solenoid, an accumulator, an umbilical connector, a valve, and an electronics module.

Example 10

A susbsea safety tree system, comprising:

a subsea safety tree;

a retainer valve; and a modular control system configured to control functions of the subsea safety tree and the retainer valve, the modular control system comprising:

a first manifold module (MM1) comprising:

an $MM_1$ body comprising an MM1 first end, an MM1 second end, an inner profile, and an outer profile, the inner profile defining an orifice configured to receive a pipe therethrough; and an MM1 path defined between the inner profile and the outer profile and extending to at least one of the MM1 first end and the MM1 second end; and a second manifold module (MM2) comprising:

an MM2 body comprising an MM2 first end, an MM2 second end, an inner profile, and an outer profile, the inner profile defining an orifice configured to receive the pipe therethrough; and an MM2 path defined between the inner profile and the outer profile and extending to at least one of the MM2 first end and the MM2 second end, wherein the MM1 first end is coupled to the MM2 second end.

Example 11

The subsea safety tree system, comprising: wherein the first manifold module and the second manifold ring are traversed by a control line.

Example 12

The modular manifold system of claim 10, wherein the control line is configured to control an element of the subsea safety tree or retainer valve.

Example 13

The modular manifold system of claim 10, wherein the MM1 path is in fluid or electrical communication with the MM2 path.

Example 14

The modular manifold system of claim 10, wherein at least one of the first manifold module and the second manifold module is a part of an electrohydraulic control system.

Example 15

The modular manifold system of claim 10, wherein the first manifold module comprises at least one of a sensor, a solenoid, an accumulator, an umbilical connector, a valve, and an electronics module.

Example 16

The modular manifold system of claim 10, wherein the MM1 body and the MM2 body are tubular in shape.

Example 17

A method of forming a manifold for an electrohydraulic control system, comprising:

providing a first manifold module, the first manifold module comprising a first end, second end, a central orifice for receiving a pipe therethrough, and a path extending to at least one of the first end and the second end;

providing a second manifold module, the second manifold module comprising: a first end, second end, a central orifice for receiving the pipe therethrough, and a path extending to at least one of the first end and the second end;

coupling the first manifold module to the second manifold module, putting the path of the first manifold module in communication with the path of the second manifold module; and disposing the first manifold module and the second manifold module around the pipe.

Example 18

The method of claim 17, wherein the paths of the first and second manifold modules comprises a hydraulic path, a pneumatic path, an electrical path, or any combination thereof.

Example 19

The method of claim 17, wherein the tubular structure comprises an outer surface and an inner surface, and the path is formed between the outer surface and the inner surface.

Example 20

The method of claim 17, wherein the modular manifold comprises at least one of a sensor, a solenoid, an accumulator, an umbilical connector, a valve, and an electronics module.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A control system for controlling subsea well equipment, comprising:

a manifold comprising at least one manifold module, the manifold module comprising:

a body including an inner wall defining an orifice, an outer wall, a first end, and a second end;

a first path formed between the inner wall and the outer wall and extending to at least one of the first end and the second end;

a second path formed between the inner wall and the outer wall and extending through the manifold from the first end to the second end; and a component disposed on the inner wall or the outer wall of the body and in fluid or electrical communication with the first path;

wherein the second path is configured to provide communication through the manifold to at least one of another manifold module and the subsea well equipment.

2. The control system of claim 1, wherein the path is extruded from the body.

3. The control system of claim 1, wherein the paths of the manifold module include an electrically conductive path, a hydraulic path, a pneumatic path, or any combination thereof.

4. The control system of claim 1, wherein the orifice is configured to receive a pipe therethrough.

5. The control system of claim 1, wherein the manifold module is coupled to the other manifold module and the second path of the manifold module is coupled to the other manifold module via a seal.

6. The control system of claim 1, wherein the manifold module further comprises a first coupling mechanism and is coupleable to another manifold module or well equipment only if the other manifold module or well equipment comprises a second coupling mechanism compatible with the first coupling mechanism.

7. The control system of claim 1, wherein the body of the manifold module comprises a ring.

8. The control system of claim 1, wherein the manifold module is a part of an electrohydraulic control system.

9. The control system of claim 1, wherein the manifold module comprises at least one of a sensor, a solenoid, an accumulator, an umbilical connector, a valve, and an electronics module.

10. A subsea safety tree system, comprising:

a subsea safety tree;

a retainer valve; and a modular control system configured to control functions of the subsea safety tree and the retainer valve from above the subsea safety tree and above the retainer valve, the modular control system comprising:

a first manifold module (MM1) comprising:

an MM1 body comprising an MM1 first end, an MM1 second end, an inner profile, and an outer profile, the inner profile defining an orifice configured to receive a pipe therethrough;

an MM1 component disposed on the inner profile or the outer profile of the MM1 body; and a first MM1 path defined between the inner profile and the outer profile and extending to at least one of the MM1 first end and the MM1 second end, the first MM1 path in fluid or electrical communication with the component;

a second MM1 path formed between the inner profile and the outer profile and extending through the manifold from the first end to the second end and a second manifold module (MM2) comprising:

an MM2 body comprising an MM2 first end, an MM2 second end, an inner profile, and an outer profile, the inner profile defining an orifice configured to receive the pipe therethrough; and an MM2 path defined between the inner profile and the outer profile and extending to at least one of the MM2 first end and the MM2 second end, wherein the MM1 first end is coupled to the MM2 second end and the second MM1 path is in fluid or electrical communication with the MM2 path.

11. The subsea safety tree system of claim 10, comprising: wherein the first manifold module and the second manifold module are traversed by a control line.

12. The subsea safety tree system of claim 11, wherein the control line is configured to control an element of the subsea safety tree or the retainer valve.

13. The subsea safety tree system of claim 10, wherein at least one of the first manifold module and the second manifold module is a part of an electrohydraulic control system.

14. The subsea safety tree system of claim 10, wherein the first manifold module comprises at least one of a sensor, a solenoid, an accumulator, an umbilical connector, a valve, and an electronics module.

15. The subsea safety tree system of claim 10, wherein the MM1 body and the MM2 body are tubular in shape.

16. A method of forming a manifold for an electrohydraulic control system, comprising:

providing a first manifold module, the first manifold module comprising a first end, a second end, a central orifice for receiving a pipe therethrough, a first path extending to at least one of the first end and the second end, and a second path formed between an inner wall of the first manifold module and an outer wall of the first manifold module, and extending through the manifold from the first end to the second end, wherein the first manifold module comprises a component for controlling the electrohydraulic control system, the component in fluid or electrical communication with the first path;

providing a second manifold module, the second manifold module comprising: a first end, second end, a central orifice for receiving the pipe therethrough, and a path extending to at least one of the first end and the second end;

coupling the first manifold module to the second manifold module, putting the second path of the first manifold module in communication with the path of the second manifold module; and disposing the first manifold module and the second manifold module around the pipe.

17. The method of claim 16, wherein the paths of the first and second manifold modules comprises a hydraulic path, a pneumatic path, an electrical path, or any combination thereof.

18. The method of claim 16, wherein the first manifold module comprises an outer surface and an inner surface, and the path is formed between the outer surface and the inner surface.

19. The method of claim 16, wherein the first manifold module comprises at least one of a sensor, a solenoid, an accumulator, an umbilical connector, a valve, and an electronics module.

* * * * *